US006550357B1

(12) United States Patent
Freeman

(10) Patent No.: US 6,550,357 B1
(45) Date of Patent: Apr. 22, 2003

(54) WRENCH CONNECTOR

(76) Inventor: Timothy J. Freeman, 6517 Hersey Cir., North Ridgeville, OH (US) 44039

( * ) Notice: Subject to any disclaimer, the term of this patent is extended or adjusted under 35 U.S.C. 154(b) by 0 days.

(21) Appl. No.: 09/863,038

(22) Filed: May 22, 2001

(51) Int. Cl.[7] ..... B25B 23/16
(52) U.S. Cl. ..... 81/177.2; 81/180.1
(58) Field of Search ..... 81/177.2, 180.1, 81/185

(56) References Cited

U.S. PATENT DOCUMENTS 4,279,314 A 7/1981 Taub
4,836,067 A * 6/1989 Rogers et al. ..... 81/185
5,172,615 A * 12/1992 Albrecht ..... 81/185
5,216,940 A 6/1993 Hedden
5,302,069 A 4/1994 Toth et al.
5,361,656 A * 11/1994 Starr ..... 81/180.1
5,509,333 A * 4/1996 Rion ..... 81/180.1
5,797,659 A 8/1998 Fuller
5,943,924 A 8/1999 Jarvis
D420,897 S 2/2000 Fuller et al.
6,019,019 A * 2/2000 Hobbs ..... 81/177.2

* cited by examiner

*Primary Examiner*—Joseph J. Hail, III
*Assistant Examiner*—Joni B. Danganan

(57) ABSTRACT

A wrench connector it is used to connect a driver which has a driving lug, and a wrench with opposing ends for engaging fasteners, one of which ends is a closed end. The connector has opposing ends with an aperture extending from one end toward the other end. The aperture is adapted to receive the driving lug with the one end of the connector positioned adjacent the driver handle. The connector has a multifaceted outer peripheral wrench engaging surface adjacent the one end of the connector and adapted to be received by and drivingly engage the closed end of the wrench. The connector also has a retaining surface spaced from the one end of the connector and extends peripherally outwardly of the multifaceted wrench engaging surface to retain the closed end of the wrench between the driver handle and the retaining surface.

18 Claims, 4 Drawing Sheets

WRENCH CONNECTOR

BACKGROUND OF THE INVENTION

The present invention relates generally to a wrench connector and particularly to a wrench connector for connecting a driver, such as a ratchet, having a driving lug and a wrench having a closed end and another end for engaging a fastener.

A wide variety of devices utilize fasteners for a number of different purposes, such as holding components together or alternatively disassembly of those components, adjustment of the position of the faster and the like. A typical fastener has a threaded shank and a head which is formed to be engaged by a wrench. A typical example of fasteners used to hold two components together includes an opening formed around a center line in one of the components and a threaded opening formed around the same center line in the other component. The shank of the fastener is then inserted through the opening in the one component. By rotating the fastener head, the threaded shank engages the threads in the threaded opening in the other component. The head of the faster is then rotated until it engages the outer surface of the one component to secure the components together.

In many situations, the head of the fastener is difficult to access with a wrench and rotate the head. One such example occurs when a component is assembled with other components which are adjacent to and in close proximity to the head of the fastener. With limited space around the head of the fastener, it is difficult to grasp the head of the fastener with a wrench. In another example, there is limited space for positioning the wrench on the head of the fastener and additional torque is necessary to properly tighten the fastener. In yet another example, the head of the fastener may be in a position where it is necessary that the wrench is rotated by a driver which is at an angle to the wrench.

It is desirable to provide a connector for connecting a driver which has a driving lug and a handle, such as a known ratchet, with a wrench having opposing ends for engaging fasteners.

When space restrictions exist, it is desirable to maintain a connection between the ratchet and the wrench as an assembly. As the assembly is used, various forces are exerted on the components of the assembly which would tend to disassemble the components. If the assembly does not remain in an assembled position, repeated attempts must be made to tighten or loosen the fastener. Accordingly, it is also desirable to provide a connection between the ratchet and the wrench that maintains the wrench and ratchet in an assembled position during use of the assembly without requiring the mechanic to hold the wrench and ratchet together manually. In fact, in some cases, there is no space to hold the wrench and ratchet together manually.

It is also desirable to provide a connection between a ratchet and a wrench which requires a minimum of space. This desirable feature is particularly necessary in certain situations where the space for positioning the ratchet-wrench assembly is limited.

It is also desirable to provide a connection between a ratchet and a closed-end wrench assembly which positions the wrench and ratchet in as close proximity as possible so as to avoid twisting of the assembly when force is exerted on the ratchet and transmitted to the wrench.

Wrench extension devices are known in the art. Hedden in U.S. Pat. No. 5,216,940 discloses an extension apparatus and method for an open-ended wrench. When used with either two wrenches or an open-ended wrench and a ratchet, Hedden does not provide a connector which maintains the wrench and ratchet in an assembled position. In addition, the extension device disclosed in Hedden does not provide for maintaining the wrench and a ratchet in close proximity as possible so as to avoid twisting of the assembly when force is exerted on the ratchet and transmitted to the wrench.

SUMMARY OF THE PRESENT INVENTION

The present invention provides the above described desirable features with an improved connector for connecting a driver and a wrench having opposing ends for engaging fasteners. Typically, the driver has a driving lug and a handle, such as for example a ratchet. One of the ends of the wrench is closed-end with internal multiple facets and has a predetermined width.

The connector has opposing ends with a driving aperture extending from a driver end toward the other end. The aperture is adapted to receive the driving lug of the driver with the driver end of the connector positioned adjacent the driver handle. The connector has a multifaceted outer peripheral wrench engaging surface adjacent the driver end of the connector for receiving and drivingly engaging the closed end of the wrench. The connector also has a retaining surface spaced from the driver end of the connector and extends peripherally outwardly of the multifaceted wrench engaging surface to retain the closed end of the wrench between the driver handle and the retaining surface.

A typical operation using the connector of the present invention includes positioning the closed end of the wrench over the wrench engaging surface from the driver end until one side of the closed-end contacts the retaining surface. The driving lug of the ratchet is then inserted into the drive aperture until the handle of the ratchet is adjacent the other side of the closed end of the wrench. Accordingly, the wrench is connected to the ratchet. Such a design positions the wrench and a ratchet in as close proximity as possible to avoid twisting of the assembly when force is exerted on the ratchet and transmitted to the wrench.

The connector of the present invention also requires a minimum of space by positioning the wrench and ratchet adjacent each other. Such a design allows for the use of the connector of the present invention in cases where space for positioning the ratchet wrench assembly is limited.

Typical driving lugs, on for example a ratchet or socket torque wrench, are designed to frictionally engage the aperture in which they are received. One design is a spring loaded ball in one of the faces of the driving lug, resiliently extending past that face so that it exerts force on the surface of the aperture to retain the lug in position. When the wrench and the ratchet are connected with a connector of the present invention, the closed-end of the wrench is maintained in an assembled position since movement towards the driver end is restricted by the engagement of the ratchet and movement towards the other end is restricted by the retaining surface. Accordingly, the connector of the present invention maintains the wrench and ratchet in an assembled position during use of the assembly without requiring the user to hold the wrench and ratchet together manually.

As described above, in some situations it is necessary to position the driver at an angle with respect to the wrench. The present invention allows for the ratchet to be positioned in an appropriate angular position with respect to the wrench or alternatively in the case a non-ratchet driver with a lug to be positioned by inserting the lug in the aperture at an appropriate angle.

Other desirable features and advantages of the present invention will become apparent from a study of the following description and the accompanying drawings which are illustrative of the invention.

DETAILED DESCRIPTION OF THE INVENTION

Figure 1:
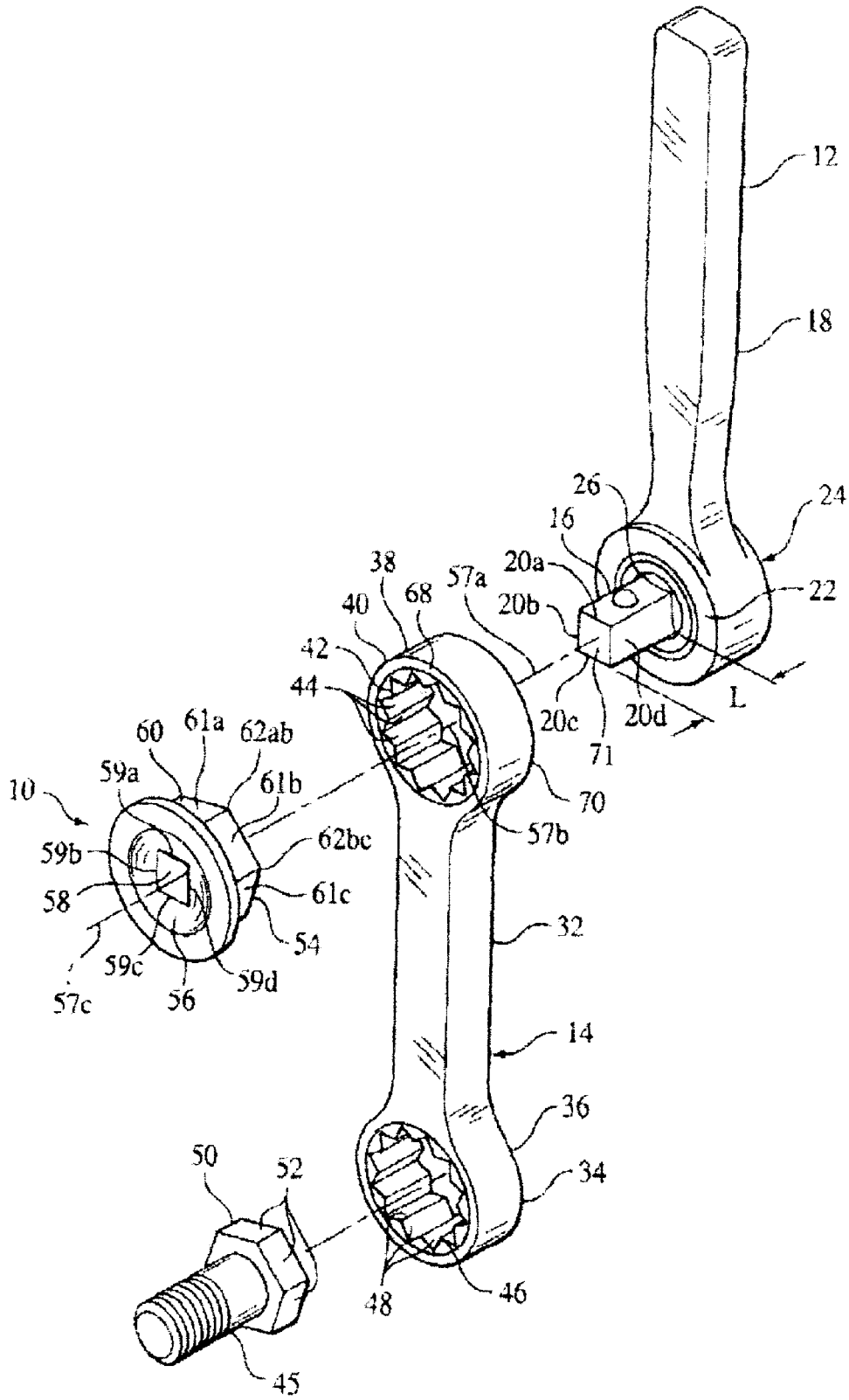
FIG. 1 is an exploded perspective view of the wrench connector of the present invention in use with a wrench and a ratchet.

The present invention provides a wrench connector with the above described desirable features that may be implemented in a variety of designs for use as a wrench connector. For ease of description, the invention will be described in connection with the wrench connector 10 shown in FIGS. 1–7 and it should be understood that the advantageous features of the present invention may be used in connection with a wide variety of constructions and designs.

The wrench connector 10 of the present invention is provided to connect a driver 12 and a wrench 14 to provide the above described desirable features. The driver 12 has a driving lug 16 and a handle 18. Typical driver's include known socket ratchets, torque wrenches, socket bars and the like. For ease of description, the driver 12 is shown as a socket ratchet 12. The lug 16 of the driver 12 has a generally square cross-section with four face surfaces 20*a*, 20*b*, 20*c*, and 20*d* which extend from the side surface 22 of the handle 18 a distance "L". The four face surfaces 20*a*, 20*b*, 20*c*, and 20*d* are formed and centered around the central axis 57*a* of the lug 16. In the socket ratchet 12 shown, the lug 16 is rotatably mounted in the handle 18 about the central axis 57*a* with a known ratchet device 24.

The ratchet device 24 may be of any known construction and is secured to the inner end 26 of the lug 16. The ratchet device 24 allows for rotation of the lug 16 with respect to the handle 18 in a selected rotational direction and secures the lug 16 to the handle 18 in the opposite rotational direction. The ratchet device 24 has a directional handle 28 to select the rotational direction of the lug 16 with respect to the handle 18, which determines whether the lug is rotated to tighten or loosen a fastener.

The wrench 14 has a handle 32 and a fastener engaging end 34 on one end 36 of the handle and a closed-end 38 on the other end 40 of the handle. The closed-end 38 of the wrench 14 has an aperture 42 therethrough which aperture is defined by multiple internal facets 44 formed about the central axis 57*b* of the closed-end 38 of the wrench 14. As shown in the drawings, the fastener engaging end 34 is provided for engaging in the fastener 45 and either tightening or loosening the fastener depending on the direction of rotation of the wrench 14.

Figure 2:
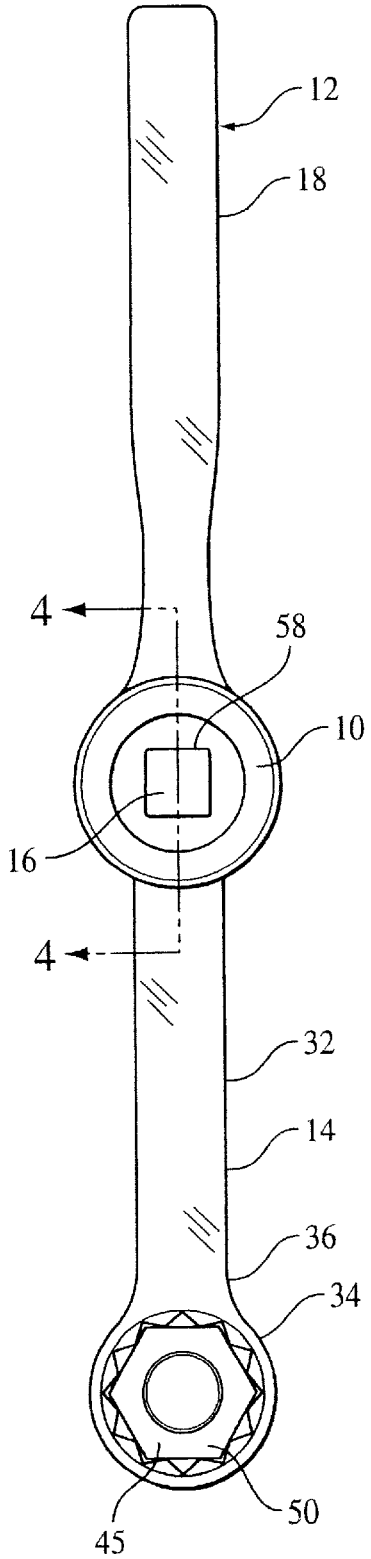
FIG. 2 is a side view of the wrench connector shown in FIG. 1 assembled with a wrench and ratchet.
Figure 3:
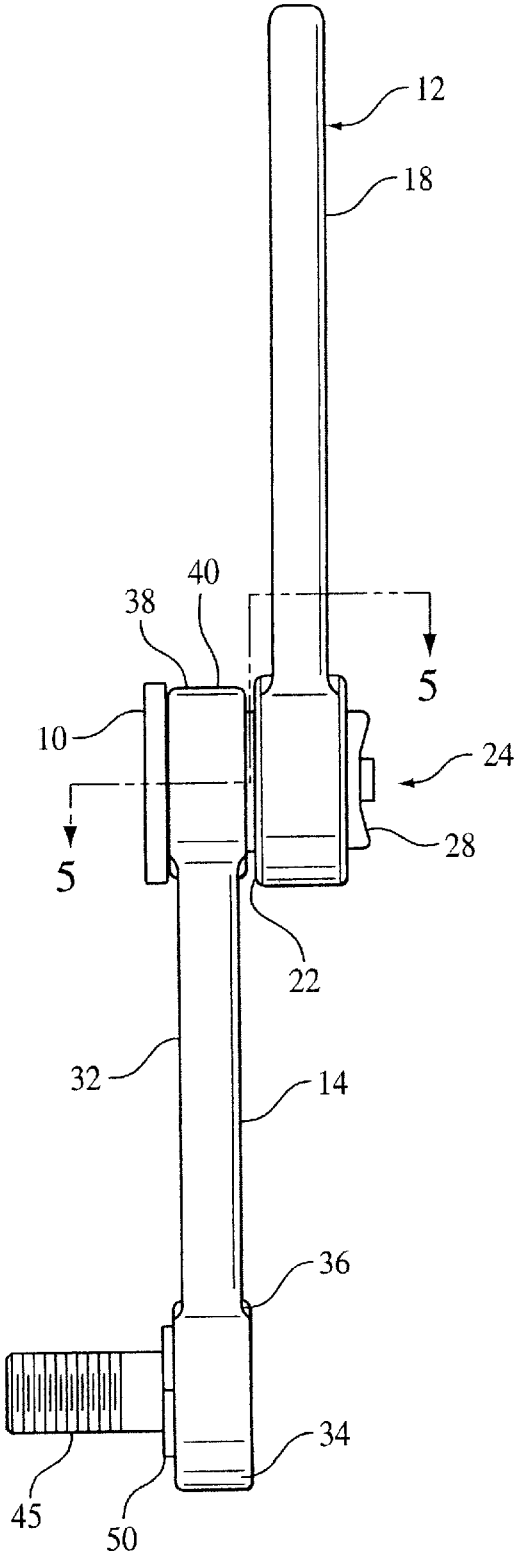
FIG. 3 is a front view of the wrench connector shown in FIG. 2 assembled with the wrench and ratchet.

The fastener engaging end 34, as shown in FIGS. 1–3, is formed in a similar manner as the closed-end 38 of the wrench 14 and has an aperture 46 therethrough which aperture is defined by internal multiple facets 48. The fastener 45 shown has a hexagonal head 50 having six flat planar peripheral walls 52 which are engaged by the internal facets 48 of the fastener engaging end 34 of the wrench 14. It should be understood that it is within the contemplation of this invention that the fastener engaging end 34 and the fastener 45 may be formed in any known manner which would provide for engagement of any known fastener by the fastener engaging end including any known open end wrench construction.

In many situations, the head 50 of the fastener 45 is difficult to access with the wrench 14, and in other situations for the operator to grip the handle 32 to rotate the head of the fastener. The wrench connector 10 of the present invention is provided to connect the wrench 14 to the driver 12 so that the fastener engaging end 34 of the wrench is rotated upon rotation of the driver and allow the fastener 50 to be either tightened or loosened. This is particularly advantageous in situations where it is difficult to access the fastener or when there is insufficient space for a mechanic to grip the wrench or when additional leverage must be exerted on the wrench or when the configuration of the device requires the driver to be at a different angle than the wrench or any combination of these situations.

The wrench connector 10 as shown in FIGS. 1, 4–7 has opposing ends 54, 56 with an driving aperture 58 extending from the driver end 54 toward the outer end 56. The aperture 58 extends from the driver end 54 through the outer end 56 along a central axis 57*c* of the wrench connector 10. The aperture 58 is formed by the side walls 59*a*, 59*b*, 59*c* and 59*d* which are complementary with the face surfaces 20*a*–20*d* respectively of the driving lug 16. As will be described herein below, the lug 16 of the driver 12 is received in the aperture 58 with the surfaces 59*a*–59*d* adjacent to and in driving engagement with their complementary surfaces 20*a*–20*d* of the lug 16. It should be understood that it is within the contemplation of this invention for the lug 16 of the driver 12 and the complementary aperture 58 to be formed in any geometric configuration that provides a driving connection between the wrench connector 10 and the driver 12 when the lug is received in the aperture 58.

The wrench connector 10 is also connectable to the wrench 14. To provide this connection, the wrench connector 10 has a multifaceted outer peripheral wrench engaging surface 60 defined by six flat planar peripheral walls 61 adjacent the driver end 54 of the wrench connector for receiving and drivingly engaging the closed end 38 of the wrench 14. The multifaceted outer peripheral wrench engaging surface 60 is formed around the central axis 57*c* of the connector 10. The peripheral walls 61 are equal in distance and join their adjacent peripheral walls at the apex point 62. For example, the peripheral walls 61*a* and 61*b* join at the apex point 62*ab* and the peripheral walls 61*b* and 61*c* join at the apex point 62*bc*, and so on with each adjacent peripheral wall 61. The peripheral walls 61 extend generally along the axis 57*c* from the driver end 54 to the retaining surface 64 of the connector 10 the distance of at least the predetermined width W of the closed-end 38 of the wrench 14.

The predetermined width W is the distance between the side surfaces 68, 70 of the closed end 38 of the wrench 14 that is assembled with the connector as will be more fully described. It should be understood that the predetermined width W may be any width W in which the closed end 38 is constructed.

It should be understood that it is within the contemplation of this invention to use a wide variety of connections between the wrench 14 and the connector 10 which provide a driving engagement between the wrench 14 and the connector. In each of these connections, the wrench 14 will be of a closed end design with an aperture that is received by and drivingly engages the wrench connector.

The retaining surface 64 of the connector 10 is provided to maintain the wrench 14 adjacent the driver 12 and in an assembled position with the driver as will be hereinafter described. The retaining surface 64 is spaced from the driver end 54 of the wrench connector 10 the distance of substantially the predetermined width W of the closed-end 38 of the wrench 14. The retaining surface 64 extends peripherally outwardly of the apex points 62 to retain the closed end 38 of the wrench 14 between the driver handle 12 and the retaining surface as well be hereinafter more fully described. The retaining surface 64 is formed on the retainer 66 of the connector 10 which extends generally radially outwardly of the central axis 57*c* of the wrench connector.

When a mechanic is confronted with a situation where the head 50 of the fastener 45 is located in a position where there is insufficient space for a mechanic to grip the handle 32 of the wrench 14, or the head 50 is difficult to access, or when it is necessary to use additional leverage in operating the wrench, or when the configuration of the device requires the driver 12 to be at a different angle than the wrench 14 or any combination of these situations, a wrench connector 10 of the present invention is assembled with the driver 12 and the wrench 14.

As seen in FIG. 1, the connector 10 is positioned with its driver end 54 adjacent one side 68 of the closed-end 38 of the wrench 14. The central axis 57*b* of the wrench 14 is positioned in alignment with the central axis 57*c* of the wrench connector 10. As the connector 10 is moved toward the wrench 14, the multifaceted outer peripheral wrench engaging surface 60 of the connector 10 enters the aperture 42 of the wrench 14 and engages the internal multiple facets 44 to create a driving relationship between the connector and the wrench. The connector is continued to be moved towards the wrench 14 until the side 68 of the wrench 14 contacts the retaining surface 64 of the retainer 66. The retaining surface 64 extends radially and peripherally outward of the apex points 62 a sufficient distance so that the side 68 of the wrench 14 can contact the retaining surface. Further axial movement of the wrench 14 in that direction along the axis 57*c* is prohibited by the retaining surface 64.

The connector-wrench assembly is then ready for assembly with the driver 12. The central axis 57*c* of the connector 10 is positioned in alignment with the central axis 57*a* of the driver 12 with the driver end 54 of the wrench connector 10 and the driver side surface 70 of the wrench 14 opposite the side surface 22 of the driver 12 and outer end 71 of the lug 16. As the connector 10 is moved towards the driver 12, the outer end 71 of the driving lug 16 is received in the aperture 58 with the side walls 59*a*–59*d* adjacent the complementary face surfaces 20*a*–20*d* respectively of the lug. The connector is continued in its movement towards the driver 12 until the driver side surface 70 of the wrench 14 is adjacent the side surface 22 of the driver 12. The distance between the retaining surface 64 and the side surface 22 of the driver 12 is substantially the distance W. Accordingly, a driving relationship is created between the connector 10, wrench 14 and driver 12.

The inner end 26 of the lug 16 is positioned in alignment with the side surface 22 of the handle 18 and extends outwardly there from a distance "L" to its outer end 30 and is received in the aperture 58. It is within the contemplation of this invention that the inner end 26 of the lug 16 may be positioned in a variety of locations and geometric configurations so long as the aperture 58 is formed to cooperate with the wrench connector 10 and to allow the driver side surface 70 of the closed-end 38 of the wrench 14 to be positioned adjacent the side surface 22 of the handle 18.

As can be seen, the present wrench connector provides a connection between a ratchet and a closed-end wrench end which positions the wrench and ratchet in as close proximity as possible so as to avoid twisting of the assembly when force is exerted on the ratchet 12 and transmitted to the wrench 14.

In this assembled position, shown in FIGS. 2–5, the closed-end 38 of the wrench 14 is positioned between the retaining surface 64 of the connector 10 and the side surface 22 of the driver. The side 68 of the wrench 14 is adjacent the retaining surface 64 of the retainer 66 and the other side or the driver side 70 is adjacent the side surface 22 of the driver 12. The width "W" of the closed-end 38 of the wrench 14 is the distance between the sides 68 and 70. The distance between the retaining surface 64 and the side surface 22 is substantially equal to the distance "W" when the connector and the driver are in an assembled position. Accordingly, movement of the wrench 14 is restrained in one direction by the retaining surface 64 and the other direction by the side surface 22.

By so holding the wrench, driver, wrench connector assembly together as a unit, the wrench 14 is restrained from movement with respect to the handle 12 along the axis 57*a*. This feature is particularly advantageous where the head 50 of the fastener 45 is located in a position where there is insufficient space for a mechanic to grip the handle 32 of the wrench 14, or the head 50 is difficult to access. The mechanic may simply position the assembly by holding the handle 18 of the driver 12 and position the wrench in driving engagement with a fastener. In some situations it is necessary to position the driver 12 at an angle with respect to the wrench 14. The present invention 10 allows for the ratchet 12 to be positioned in an appropriate angular position with respect to the wrench 14. Alternatively, in the case a non-ratchet driver its lug is inserted in the aperture at the appropriate angle.

Figure 4:
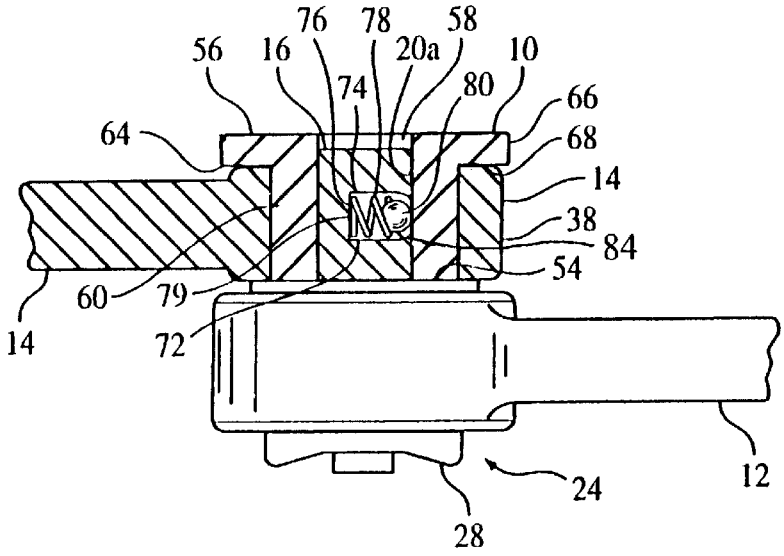
FIG. 4 is a partial sectional view of the wrench connector with the wrench and ratchet shown in FIG. 2 and taken along line 4—4 thereof.
Figure 5:
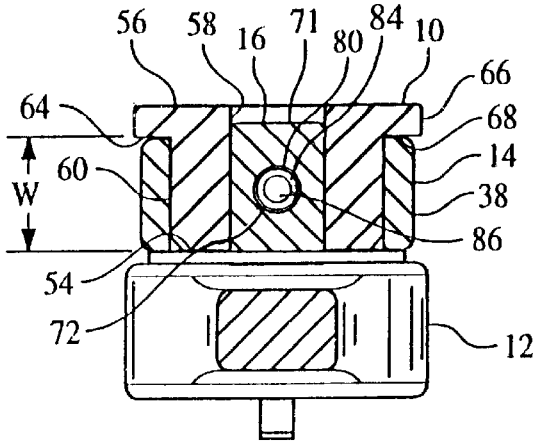
FIG. 5 is a partial sectional view of the wrench connector with the wrench and ratchet shown in FIG. 3 and taken along line 5—5 thereof.
Figure 6:
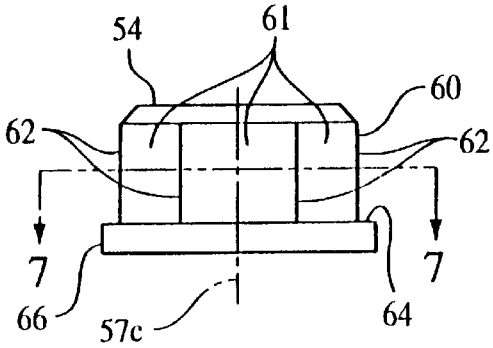
FIG. 6 is a side view of the wrench connector shown in FIG. 1.

While the friction fit between the surfaces 20*a*–20*d* of the lug 16 and the complimentary surfaces 59*a*–59*d* of the aperture 58 of the connector 10 are sufficient to hold the wrench, driver, and wrench connector assembly together, the preferred embodiment of the present invention also provides a retaining device 72 to assist in maintaining this assembly. As seen in FIGS. 4 and 5, the lug 16 has the retaining device 72, such as a spring loaded ball assembly, adjacent its face surface 20*a*. The spring loaded ball assembly 72 includes an aperture 74 extending from the surface 20*a* radially inwardly to the bottom 76 of the aperture 74. The aperture 74 has a spring 78 positioned therein with its bottom 79 in contact with the bottom 76 of the aperture. The spring loaded ball assembly 72 also has a ball 80 positioned on the top 82 of the spring 78 and is retained in that positioned by a lip 84 formed to retain the ball 80 in the aperture 74 with a portion 86 of the ball 80 extending outwardly of the surface 20 when the ball 80 is not forced inwardly.

Accordingly, when the lug 16 is received in the driving aperture 58, the ball 80 is in frictional engagement with the surface 59 of the connector 10. This connection between the connector 10 and the driver 12 maintains the wrench 14 and an assembled condition as described above. It should be understood that it is within the contemplation of this invention to use a wide variety of known retaining devices which maintain the driver 12 and the wrench connector 10 and wrench 14 in an assembled condition.

Figure 8:
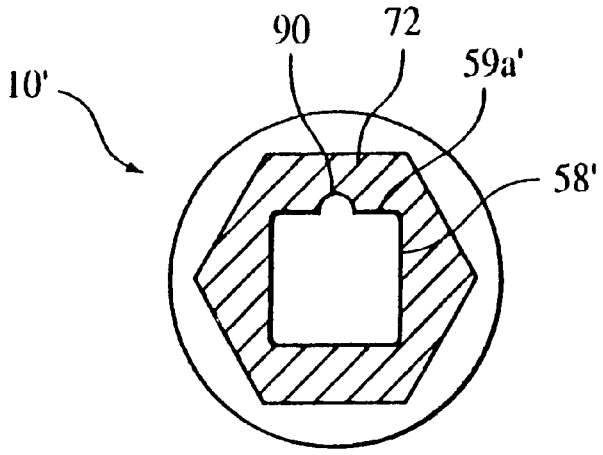
FIG. 8 is a sectional view of an alternate design for a wrench connector of the present invention.

Another embodiment of the wrench connector 10' of the present invention is shown in FIG. 8 and is similar in construction with the wrench connector 10 described above. For ease of description, the wrench connector 10' is numbered with numerals the same as used in connection with the wrench connector 10 to denote common parts where appropriate and followed by a prime mark "'" to denote the wrench connector 10'.

Figure 7:
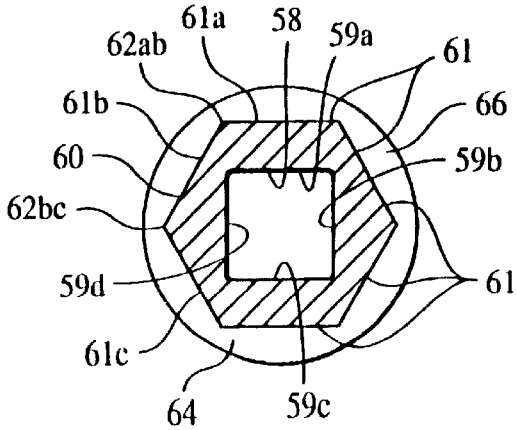
FIG. 7 is a sectional view of the wrench connector shown in FIG. 6 and taken along lines 7—7 thereof.

The lug connector 10', shown in FIG. 8, which is taken along the same line as FIG. 7 of the connector 10, as a detent or depression 90 in its surface 59*a'* which defines a portion of the aperture 58'. The detent 90 is included as part of the retaining device 72' which also includes the retaining device 72 described above and operates to maintain the driver wrench connector 10' and wrench in an assembled condition. The detent 90 is configured to receive the portion 86 of the ball 80 of the retaining device 72 when the side 68 of the wrench 14 is adjacent the retaining surface 64 of the retainer 66 and the other side or the driver side 70 is adjacent the side surface 22 of the driver 12.

The detent 90 is positioned in the surface 59*a'* so that portion 86 of the ball 80 is received therein when the wrench connector 10, driver 12 and wrench 14 are assembled as described above. When moved between an assembled or disassembled condition, the ball 80 is moved into the aperture 74 against the force of the spring 78 and when it reaches either the detent 90 or is free of the lug connector 10' the spring 78 moves the ball 80 outwardly so that the portion 68 extends past the face 20*a*. Accordingly, the cooperation of the detent 90 and the ball 80 provides a retaining device which maintains the driver, wrench connector, and wrench in an assembled condition.

Figure 9:
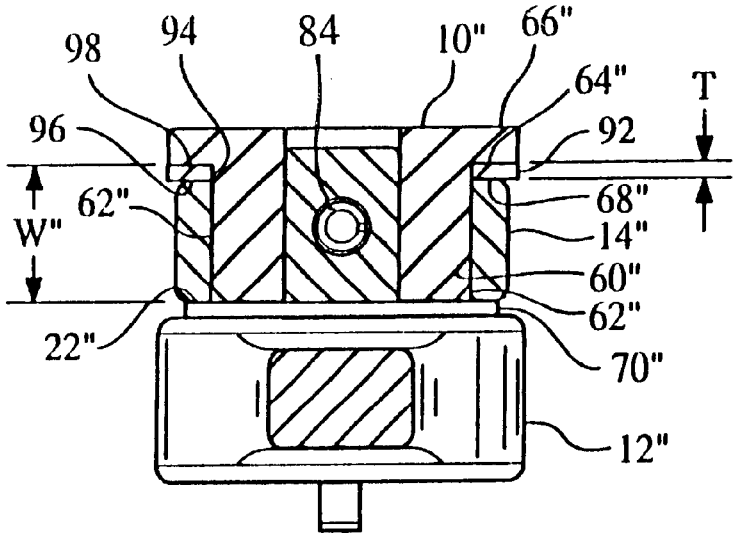
FIG. 9 is a partial sectional view of another embodiment of a wrench connector of the present invention.

Another embodiment of the wrench connector 10" of the present invention is shown in FIG. 9 and is similar in construction with the wrench connector 10 described above. For ease of description, the wrench connector 10" is numbered with numerals the same as used in connection with the wrench connector 10 to denote common parts where appropriate and followed by a double prime mark " to denote the wrench connector 10".

In some cases, the predetermined width W" of the wrench 14" shown in FIG. 9 is less than the width of other wrenches, such as the width W of the wrench 14 shown in FIG. 5. In order to maintain the driver 12", wrench connector 10" and wrench 14" in an assembled condition so that the wrench and the driver do not "wobble" with respect to each other, the wrench connector 10' includes a surface extender device 92 as shown in FIG. 9. This feature is particularly important when the mechanic must grasp the driver 12" to move the wrench 14" in the driving engagement with a fastener. If the wrench was allowed to wobble, it is extremely difficult and frustrating for the mechanic to move the wrench into driving engagement with a fastener.

As shown in FIG. 9, the width W" of the wrench 14" is less than the width W of the wrench 14 and when the wrench connector 10", driver 12" and wrench 14" are assembled, there is a space between the side surface 22" of the driver 12" and the surface 70" of the wrench and/or between the retaining surface 64" of the retainer 66" and the side surface 68" of the wrench 14", depending on the position of the wrench on the connector. This space allows the wrench 14" to wobble with respect to the driver 12". To minimize this wobble, the surface extender device 92 is provided and has a central aperture 94 which is slidably received by the wrench engaging surface 60" of the connector 10". The aperture 94 may be of any desirable geometric configuration which allows it to slide axially on the wrench engaging surface 60". As shown, the aperture 94 is circular and rides on the apex points 62" of the wrench engaging surface. It is also within the contemplation of this invention to utilize alternate geometric configurations for the aperture 94.

The surface extender 92 as a wrench side surface 96 which contacts the side surface 68" of the wrench 14" and a side surface 98 which contacts the retaining surface 64" of the retainer 66" when the connector 10", driver 12" and wrench 14" are in an assembled condition. The surface extender 92 has a thickness "T", or the distance between the side surfaces 96, 98, that is sufficient to position the side surface 22" of the driver 12" and the surface 70" of the wrench adjacent each other to minimize wobbling in an assembled condition. The surface extender 92 provides for connecting a ratchet 12" and a closed-end wrench 14" which positions the wrench and ratchet in as close proximity as possible so as to avoid twisting of the assembly when force is exerted on the ratchet and transmitted to the wrench.

It should be understood that it is within the contemplation of this invention to position the surface extender 92 between the between the side surface 22" of the driver 12" and the surface 70" of the wrench so that the surface 68" of the wrench 14" is in contact with the retaining surface 64" of the retainer 66"'. It is within the contemplation of this invention to provide other surface extender devices which extends one of the surfaces to keep a tight fit between the driver 12" and the wrench 14" when assembled.

The invention has been described with reference to the preferred and other embodiments. Obviously, modifications and alterations will occur to others upon reading and understanding this specification. It is my intention to include all modifications and alterations in so far as they come within the scope of the appended claims or equivalents thereof.

Having described my invention, I claim:

1. A wrench connector for connecting a driver which has a driving lug and a handle for rotating the driving lug, and a wrench having opposing ends for engaging fasteners, one of which ends is a closed end with internal multiple facets and having a predetermined width, said connector having:

a) opposing ends and an aperture extending from one of said opposing ends toward the other of said opposing ends of said connector, said aperture adapted to drivingly engage the driving lug of the driver, said aperture adapted to receive the driving lug to position said one end of said connector adjacent the drive handle, b) a multifaceted outer peripheral wrench engaging surface adjacent said one end of said connector and having a plurality of facets adapted to be received by and drivingly engage the closed end of the wrench, c) a retaining surface spaced from said one end of said connector and extending peripherally outwardly of said multifaceted wrench engaging surface and adapted to retain the closed end of the wrench between the drive handle and said retaining surface, and d) a surface extender device adapted to be positioned adjacent one of said retaining surface and said one opposing end.

2. The wrench connector as described in claim 1 in which said retaining surface is spaced from said one end of said connector substantially the predetermined width of the closed end.

3. The wrench connector as described in claim 1 in which said aperture has a square cross section.

4. The wrench connector as described in claim 1 in which said aperture extends from said one side through said other side of said connector.

5. The wrench connector as described claim 1 which includes a retaining device.

6. The wrench connector as described claim 5 in which said aperture is formed from a plurality of side surfaces, said retaining device including a detent in at least one of said side surfaces.

7. The wrench connector as described in claim 1 wherein said aperture and said multifaceted outer peripheral wrench engaging surface are formed about a common rotational axis.

8. The wrench connector as described in claim 1 in which said retaining surface extends radially outwardly of each of said facets on said wrench engaging surface.

9. In combination, a wrench connector, a driver and a wrench, said driver having a driving lug and a handle;

said wrench having opposing ends, each end for engaging fasteners, one of said ends is a closed end with internal multiple facets and having a predetermined width; and said wrench connector having:

a) opposing ends and an aperture extending from one of said opposing ends toward the other of said opposing ends of said connector, said aperture drivingly engaging said driving lug of said driver, said driving lug received in said aperture with said one end of said connector adjacent the driver handle, b) a multifaceted outer peripheral wrench engaging surface adjacent said one end of said connector and having a plurality of facets received by and drivingly engaged with the closed end of the wrench, and c) a retaining surface spaced from said one end of said connector and extending peripherally outwardly of said multifaceted wrench engaging surface for retaining said closed end of said wrench between said driver handle and said retaining surface.

10. The wrench connector as described in claim 9 in which said retaining surface is spaced from said one end of said connector at least said predetermined width of said closed end.

11. The wrench connector as described in claim 9 in which said aperture has a square cross section.

12. The wrench connector as described in claim 9 in which said aperture extends from said one side through said other side of said connector.

13. The wrench connector as described claim 9 which includes a retaining device.

14. The wrench connector as described claim 3 in which said aperture is formed from a plurality of side surfaces, said retaining device including a detent in at least one of said side surfaces.

15. The wrench connector as described claim 9 in which said aperture is formed from a plurality of side surfaces, at least one of said side surfaces having a detent therein.

16. The wrench connector as described in claim 9 wherein said aperture and said multifaceted outer peripheral wrench engaging surface are formed about a common rotational axis.

17. The wrench connector as described in claim 9 which said retaining surface extends radially outwardly of each of said facets on said wrench engaging surface.

18. The wrench connector as described in claim 9 which includes a surface extender device adapted to be positioned between said closed end of said wrench and one of said retaining surface and said one opposing end of said connector.

* * * * *